United States Patent [19]

Leprohon, Jr. et al.

[11] 4,051,661

[45] Oct. 4, 1977

[54] WIRE STRAND AND ROPE

[75] Inventors: Louis C. Leprohon, Jr.; John C. Overdurf, Jr., both of Williamsport, Pa.

[73] Assignee: Bethlehem Steel Corporation, Bethlehem, Pa.

[21] Appl. No.: 723,366

[22] Filed: Sept. 15, 1976

[51] Int. Cl.[2] ..... D07B 1/06

[52] U.S. Cl. ..... 57/148; 57/139

[58] Field of Search ..... 57/139, 144, 145, 148

[56] References Cited

U.S. PATENT DOCUMENTS

| | | | |
|---|---|---|---|
| 1,779,471 | 10/1930 | Howe | 57/148 |
| 3,092,956 | 6/1963 | Naysmith | 57/148 X |
| 3,306,022 | 2/1967 | Stevens | 57/148 |
| 3,972,175 | 8/1976 | Hiller | 57/145 |
| 3,977,174 | 8/1976 | Boileau | 57/145 |

*Primary Examiner*—Donald Watkins

*Attorney, Agent, or Firm*—Joseph J. O'Keefe; Michael J. Delaney

[57] ABSTRACT

A wire strand is made by helically winding a number of layers of steel wire around a steel king wire. The wires in such layers are made from a first steel grade while the king wire is made from a second steel grade. In addition, the outermost layer of wire in the strand may be made from a third steel grade. A wire rope is formed by helically winding a number of such wire strands around a wire core.

20 Claims, 3 Drawing Figures

| WIRE ROPE DIAM. INCHES | WIRE STRAND | | | | | | |
|---|---|---|---|---|---|---|---|
| | WIRE SIZES-IN INCHES | | | | | | DIAMETER INCHES |
| | 1 KING | 6 1ST LAYER | 8 2ND LAYER | 8 3RD LAYER | 16 4TH LAYER | 16 OUTERMOST LAYER | |
| 2 1/4 | .175 | — | .104 | .040 | .083 | .114 | .738 |
| 2 3/8 | .188 | — | .107 | .042 | .088 | .118 | .769 |
| 2 1/2 | .195 | — | .114 | .044 | .092 | .126 | .815 |
| 2 5/8 | .072 | .066 | .116 | .046 | .098 | .130 | .846 |
| 2 3/4 | .077 | .069 | .124 | .048 | .101 | .138 | .892 |
| 2 7/8 | .080 | .072 | .130 | .050 | .105 | .145 | .935 |

| | 1 KING | 8 1ST LAYER | 8 2ND LAYER | 8 3RD LAYER | 16 4TH LAYER | 16 OUTERMOST LAYER | DIAMETER INCHES |
|---|---|---|---|---|---|---|---|
| 3 | .118 | .069 | .136 | .052 | .110 | .148 | .967 |
| 3 1/8 | .126 | .072 | .141 | .056 | .116 | .154 | 1.010 |
| 3 1/4 | .130 | .075 | .145 | .056 | .118 | .160 | 1.040 |
| 3 3/8 | .135 | .077 | .152 | .058 | .121 | .166 | 1.078 |
| 3 1/2 | .138 | .083 | .156 | .062 | .126 | .172 | 1.120 |
| 3 5/8 | .145 | .085 | .163 | .063 | .130 | .177 | 1.158 |
| 3 3/4 | .148 | .088 | .168 | .066 | .135 | .185 | 1.202 |
| 3 7/8 | .152 | .090 | .175 | .068 | .141 | .190 | 1.243 |
| 4 | .156 | .093 | .180 | .069 | .145 | .196 | 1.279 |
| 4 3/8 | .218 | 9 .107 | 9 .195 | 9 .072 | 18 .148 | 18 .193 | 1.393 |
| 4 1/2 | .224 | .110 | .200 | .075 | .152 | .198 | 1.432 |

| | | | | | | | |
|---|---|---|---|---|---|---|---|
| 4 3/4 | 1 .083 | 6 .077 | .116 | .212 | .080 | .160 | .210 | 1.513 |
| 5 | .088 | .081 | .121 | .224 | .085 | .168 | .220 | 1.593 |

FIG. 2

FIG. 3

| WIRE ROPE DIAM. INCHES | 7X7 INDEPENDENT WIRE ROPE CORE | | | | |
|---|---|---|---|---|---|
| | DIAM. INCHES | WIRE SIZES IN INCHES | | | |
| | | CORE STRAND | | OUTER STRAND | |
| | | 1 CENTER | 6 OUTERS | 1 CENTER | 6 OUTERS |
| 2 1/4 | .906 | .118 | .102 | .102 | .095 |
| 2 3/8 | .941 | .121 | .107 | .107 | .098 |
| 2 1/2 | 1.004 | .124 | .116 | .116 | .104 |
| 2 5/8 | 1.040 | .128 | .118 | .118 | .110 |
| 2 3/4 | 1.095 | .135 | .124 | .124 | .116 |
| 2 7/8 | 1.141 | .141 | .132 | .132 | .118 |
| 3 | 1.183 | .143 | .136 | .136 | .124 |
| 3 1/8 | 1.236 | .152 | .141 | .141 | .130 |
| 3 1/4 | 1.268 | .160 | .145 | .145 | .132 |
| 3 3/8 | 1.323 | .163 | .152 | .152 | .138 |
| 3 1/2 | 1.372 | .168 | .158 | .158 | .143 |
| 3 5/8 | 1.415 | .175 | .160 | .160 | .150 |
| 3 3/4 | 1.464 | .180 | .165 | .165 | .156 |
| 3 7/8 | 1.516 | .188 | .172 | .172 | .160 |
| 4 | 1.555 | .195 | .175 | .175 | .165 |
| 4 3/8 | 1.692 | .212 | .190 | .190 | .180 |
| 4 1/2 | 1.738 | .218 | .195 | .195 | .185 |
| 4 3/4 | 1.840 | .232 | .207 | .207 | .195 |
| 5 | 1.937 | .245 | .218 | .218 | .205 |

WIRE STRAND AND ROPE

BACKGROUND OF THE INVENTION

Wire rope has been used for a variety of applications. The applications are so numerous and operating conditions so variable that no one type of wire rope can be universally applied. This invention relates primarily to wire rope which is subjected to the operating conditions found during earth excavation. Excavator wire rope must possess a high degree of abrasion resistance, bending fatigue resistance, strength and ductility. In addition, it is economically desirable that the service life of excavator wire rope be as long as possible.

It has been found that when the king wire, i.e. the center wire of a strand, breaks, the shape and integrity of the strand is immediately affected by the shifting or movement of the layers of wires being supported by the king wire. Such movement of wires results in a loss of breaking strength of excavator wire rope.

It has also been found that the physical properties of the wires in the outer layer of each wire strand of a wire rope have a significant influence on the performance and service life of excavator wire rope. Such wires should have a high degree of resistance to abrasion and bending fatigue.

SUMMARY OF THE INVENTION

This invention relates in general to an improved wire strand and wire rope and in particular to an improved excavator wire strand and wire rope.

An object of this invention is to provide a wire strand and rope which has improved performance and service life.

The above objects can be accomplished by providing a wire strand with the individual wires of the strand made from carefully selected grades of steel. Specifically, the wire strand includes a plurality of layers of wires helically wound around a king wire. The wires in such layers are made from a first steel grade and the king wire is made from a second steel grade. Furthermore, the outermost layer of wires may be made from a third steel grade. In forming a wire rope from such wire strand, a plurality of strands are wound helically around an independent wire rope core (IWRC). The first steel grade is grade designation AISI 1080, the second steel grade designation is AISI 1038, and the third steel grade designation is AISI 1070.

BRIEF DESCRIPTION OF THE DRAWINGS

FIG. 2 shows a listing of preferred wire rope constructions for rope diameters of 2¼ inches to 5 inches.

FIG. 3 shows a listing of preferred construction for an independent wire rope core (IWRC).

DETAILED DESCRIPTION OF THE DRAWINGS

Figure 1:
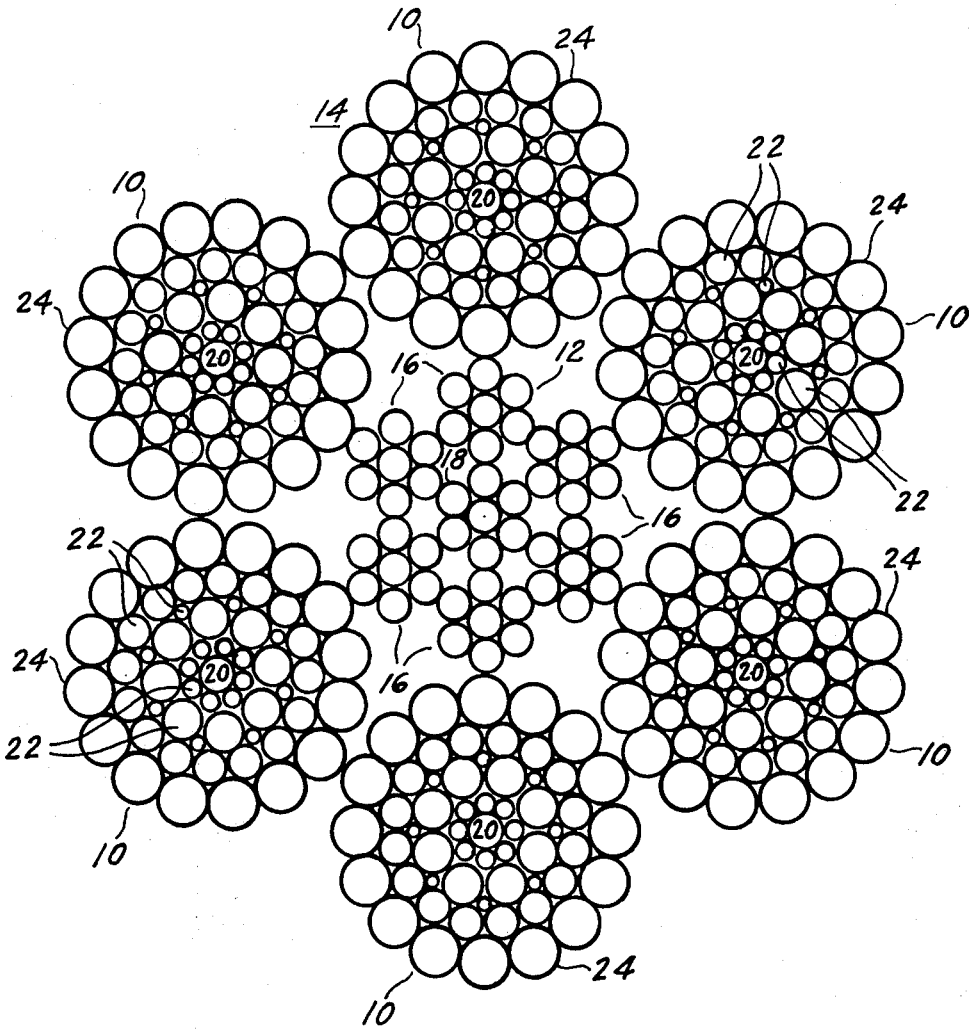
FIG. 1 shows a cross section of an example of an excavator wire rope.

FIG. 1 shows an example of an excavator wire rope formed from a plurality of wire strands 10 helically wound together about a core 12 to form a wire rope 14. The core 12 consists of an independent wire rope core (IWRC) made by helically winding six strands 16 about a center strand 18. The IWRC can be designated 7×7, i.e. seven strands consisting of 7 wires per strand. Each wire strand 10 consists of a king wire 20, intermediate layers of wires 22 and an outermost layer of wire 24.

The layers of wires 22 and 24 are helically wound about the king wire to form the wire strand 10.

This invention is particularly applicable to excavator wire rope having a rope diameter in the range of 2¼ inches to 5 inches. However, those skilled in the wire rope art will recognize that this invention is not limited to such range and can be applied to rope diameters outside such range.

By way of example, FIG. 2 lists the preferred excavator wire rope construction for wire rope diameters from 2¼ inches to 5 inches. Obviously, other wire rope constructions could be used in the practicing of this invention, as well as other wire rope diameters. Each wire rope shown in FIG. 2 is made from 6 wire strands helically wound about a 7×7 IWRC. All dimensions listed in FIG. 2 are in inches. The first column lists the wire rope diameter. Under the columns headed wire sizes, there appear the number of wires in each layer along with the size of such wires. For example, there are eight wires having a diameter of 0.104 inches in the 2nd layer of wires. The layers of wires are numbered by labeling the layer in contact with the king wire as the first layer with the next layer as the 2nd layer, etc. It should be noted that for wire rope diameters of 2¼ inches, 2⅜ inches and 2½ inches there is no listing of wire size under the column headed "1st layer". Thus for wire rope diameters of 2¼ inches, 2⅜ inches and 2½ inches, the 2nd layer of wires is in contact with the king wire. The column immediately to the right of the column listing the diameter of the 16 wires in the outermost layer shows the diameter of the wire strand. It will be seen that all sizes of wire rope except the 4¾ inch and 5 inch rope have one king wire, whereas the 4¾ inch and 5 inch rope have a king wire designed as one wire surrounded by six wires. The reason for using one wire surrounded by a layer of six wires for the king wire is because if one king wire was used the diameter of the single king wire would be too large (about ¼ inch) and adversely effect the flexibility and manufacture of the strand.

By way of example, FIG. 3 lists the preferred construction for a 7×7 IWRC for wire rope diameters in the range of 2¼ inches to 5 inches. Obviously, other constructions for an IWRC and other wire cores could be used with this invention. Each IWRC shown in FIG. 3 is made from six outer strands helically wound about a core strand. Each strand (core and outer) of the IWRC is made from six outer wires helically wound about a center wire. FIG. 3 lists in inches the diameter of each IWRC for wire rope diameters between 2¼ inches and 5 inches. In addition, FIG. 3 lists the wire size in inches for the center and outer wires of the core strand and the outer strands of an IWRC for use with the indicated wire rope diameters.

The following Table No. 1 lists the range of tensile strengths in pounds per sq. in. for the intermediate layers of wires in each of the wire strands of a wire rope made in accordance with this invention.

Table No. 1

| Wire Diameter inches | Tensile Strength Range PSI |
|---|---|
| .0301.047 | 280,000/310,000 |
| .048/.072 | 274,000/304,000 |
| .073/.100 | 270,000/300,000 |
| .101/.124 | 266,000/296,000 |
| .125/.150 | 260,000/290,000 |
| .151/.210 | 254,000/284,000 |
| .211/.236 | 250,000/280,000 |

The following Table No. 2 lists the range of tensile strengths in pounds per sq. in. for the wires in the outermost layer of a wire strand.

Table No. 2

| Wire Diameter inches | Tensile Strength Range PSI |
|---|---|
| .114/.220 | 220,000/250,000 |

The following Table No. 3 lists the range of tensile strengths in pounds per sq. in. for the king wire of a wire strand.

Table No. 3

| Wire Diameter inches | Tensile Strength Range PSI |
|---|---|
| .048/.072 | 176,000/198,000 |
| .073/.100 | 172,000/194,000 |
| .101/.124 | 168,000/190,000 |
| .125/.150 | 162,000/184,000 |
| .151/.210 | 158,000/180,000 |
| .211/.236 | 152,000/174,000 |

As noted above by a comparison of the tensile strengths for the king wires shown in Table No. 3 and the wires in the intermediate layers shown in Table No. 1, the king wire is of a lower tensile strength. It has been found that such lower tensile strength significantly reduces the breakage of a king in a wire strand. Thus, the service life of such strand is significantly extended without any substantial reduction in the strength of the strand or a wire rope made from such strand. For example, the breaking strength of a 3 inch diameter wire rope constructed in accordance with FIG. 2 would be decreased by only 1.77% if all six king wires were broken and by only 0.295% if one king wire. Thus, it is not the decrease in the strength of the strand, which results when a king wire breaks, which leads to breakage of the wire strand, but it is the loss of shape and integrity of the strand by the movement of the layers of wires being supported by the king wire which cause the breakage of the strand when a king wire breaks. In view of the above, it was unexpectedly found by the inventors of this invention that the tensile strength of the king wire could be reduced and the service life of the strand and rope made from such strand could be extended. By using a king wire having a tensile strength and grade as disclosed above, the inventors have found that such king wire has 60% more resistance to breakage than if the king wire was of the same grade and tensile strength as the wires in the intermediate layers. While it is not fully understood how such lower tensile strength king wire extends the service life of the strand and rope, it is the inventors' theory that the lower tensile strength allows the king wire to somewhat deform and better support the layers of wires and in so doing the king wire is also better supported. Such better support results in a significantly reduced incidence of king wire breakage. However, the inventors do not wish to be held to such a theory as a functional and necessary part of their invention.

As noted above by a comparison of the tensile strengths for the outermost wires in Table No. 2 and the intermediate wires of Table No. 1, the outermost layer of wires are of a lower tensile strength. It has been found that such lower tensile strength of the wires in the outermost layer of wires provides an unexpected improved resistance to bending fatigue and abrasion. Thus, the service life of the wire strand and a wire rope made from such strand is significantly and unexpectedly improved. While it is not fully understood how such lower tensile strength of the outermost wires extends the service life of a wire rope, it is the inventors' theory the lower tensile strength allows the outermost wires to deform inwardly and receive better support from the next layer of wires. In addition, the outer surface of such wires deforms such that a greater bearing area is in contact with the grooves of the various sheaves used in the excavation equipment. The better support reduces any tendency for the outermost wires to move, and a reduction in movement of such wires also reduces the breakage of such wires. In deforming, the outer surface of the wire is work hardened, and thus resistance to abrasion and bending fatigue is increased. Furthermore, since a greater area is in contact with the grooves of the various sheaves the unit pressure on such area is decreased and resistance to abrasion is increased. However, the inventors do not wish to be held to such a theory as a functional and necessary part of their invention.

The inventors have found that the wire rope of their invention, including wires having tensile strengths as listed in Table Nos. 1, 2 and 3, has about a 25% greater service life than a wire rope with all wires having the tensile strengths listed in Table No. 1.

SPECIFIC EXAMPLE

Referring to FIGS. 1, 2 and 3, it is desired to construct a 3 inch diameter wire rope. As shown in FIG. 1 the wire rope consists of six outer strands and a 7×7 IWRC. As shown on FIG. 3, the 7×7 IWRC has a diameter of 1.183 inches and is made from six outer wire strands having six wires of 0.124 inch diameter helically wound about a center wire of 0.136 inch diameter. The outer strands are helically wound about a core strand having six outer wires of 0.136 inch diameter helically wound about a center wire of 0.143 inch diameter. As noted in FIG. 2 the wire strand of a 3 inch diameter rope consists of the following wires: (a) one king wire, (b) a 1st layer (layer in contact with the king wire) of eight wires having a wire diameter of 0.069 inches, (c) a second layer of eight wires having a wire diameter of 0.136 inches, (d) a third layer of eight wires having a wire diameter of 0.052 inches, (e) a fourth layer of sixteen wires having a wire diameter of 0.110 inches, and (f) an outermost layer of sixteen wires having a wire diameter of 0.148 inches. The wire strand diameter is 0.967 inches. The layers of wires in each strand are helically wound about the king wire, while each strand is helically wound about the IWRC. The king wire of each wire strand is made from steel grade AISI 1038, the wires in the outermost layer of each strand are made from steel grade AISI 1070, and the other wires of each strand are made from steel grade AISI 1080.

Referring to Table No. 1, the wires in the layers between the king wire and the outermost layer of wires would be provided with the following tensile strengths in pounds per sq. in.:

| Wire Diameter inches | Layer | Tensile Strength Range PSI |
|---|---|---|
| .069 inch | 1st | 274,000/304,000 |
| .136 inch | 2nd | 260,000/290,000 |
| .052 inch | 3rd | 274,000/304,000 |
| .110 inch | 4th | 266,000/296,000 |

Referring to Table No. 2, the wires in the outermost layer have a diameter of 0.148 inches and would be provided with a tensile strength in the range of 220,000 to 250,000 pounds per square inch.

Referring to Table No. 3, the king wire has a diameter of 0.118 inches and would be provided with a tensile strength in the range of 168,000 to 190,000 pounds per square inch.

The inventors have found that the wire rope of this specific example has about 25% greater service life than a wire rope made with all of its wires having tensile strengths as listed in Table No. 1.

This invention is not restricted to the specific wire strand or wire rope construction set forth above by way of example. Furthermore the specific IWRC set forth above can be replaced by any of various other types of wire cores.

We claim:

1. A steel wire strand comprising a plurality of layers of steel wires helically wound around a steel king wire with all the wires in the layers made from a first steel grade and the king wire made from a second steel grade.

2. The strand of claim 1 wherein the outermost layer of steel wires is made from a third steel grade.

3. A steel wire strand comprising a plurality of layers of steel wires helically wound around a steel king wire with all the wires in the layers made from a first steel grade and the king wire made from a second steel grade wherein said wire strand is constructed in accordance with FIG. 2, the king wire has a tensile strength in accordance with Table No. 3 and the other wires of the strand have a tensile strength in accordance with Table No. 1.

4. A steel wire strand comprising a plurality of layers of steel wires helically wound around a steel king wire with all the wires in the layers made from a first steel grade and the king wire made from a second steel grade wherein the outermost layer of steel wires is made from a third steel grade and wherein said wire strand is constructed in accordance with FIG. 2, the king wire has a tensile strength in accordance with Table No. 3, the wires in the outermost layer have a tensile strength in accordance with Table No. 2, and the other wires of the strand have a tensile strength in accordance with Table No. 1.

5. The strand of claim 3 wherein said first steel grade is AISI 1080 and said second steel grade is AISI 1038.

6. The strand of claim 4 wherein said first steel grade is AISI 1080, said second steel grade is AISI 1038, and said third steel grade is AISI 1070.

7. A wire rope comprising a plurality of steel wire strands helically wound around a steel wire core with each strand including a plurality of layers of steel wires helically wound around a steel king wire with all the wires in the layers made from a first steel grade and the king wire made from a second steel grade.

8. A wire rope comprising a plurality of steel wire strands helically wound around a steel wire core with each strand including a plurality of layers of steel wires helically wound around a steel king wire with all the wires in the layers made from a first steel grade and the king wire made from a second steel grade, said wire rope having a diameter range from 2¼ inches to 5 inches and six steel wire strands, with each strand constructed in accordance with FIG. 2, the king wire of each strand having a tensile strength in accordance with Table No. 3, and the other wires of each strand having a tensile strength in accordance with Table No. 1.

9. The wire rope of claim 8 having an independent wire rope core.

10. The wire rope of claim 7 wherein the outermost layer of steel wires in each strand is made from a third steel grade.

11. A wire rope comprising a plurality of steel wire strands helically wound around a steel wire core with each strand including a plurality of layers of steel wires helically wound around a steel king wire with all the wires in the layers made from a first steel grade and the king wire made from a second steel grade and the outermost layer of steel wires in each strand is made from a third steel grade, said wire rope having a diameter range from 2¼ inches to 5 inches and six steel wire strands, with each strand constructed in accordance with FIG. 2, the king wire of each strand has a tensile strength in accordance with Table No. 3, the wires in the outermost layer have a tensile strength in accordance with Table No. 2, and the other wires have a tensile strength in accordance with Table No. 1.

12. The wire rope of claim 11 wherein the first steel grade is AISI 1080, the second steel grade is AISI 1038 and the third steel grade is AISI 1070.

13. A steel wire strand comprising a plurality of layers of steel wires helically wound around a steel king wire with all the wires in the layers made from a first steel grade having a tensile strength of between about 250,000 psi and about 310,000 psi and the king wire made from a second steel grade having a tensile strength of between about 152,000 psi and about 198,000 psi.

14. The strand of claim 13 wherein the outermost layer of steel wire is made from a third steel grade having a tensile strength of between about 220,000 psi and about 250,000 psi.

15. A wire rope comprising a plurality of steel wire strands helically wound around a steel wire core with each strand including a plurality of layers of steel wires helically wound around a steel king wire with all the wires in the layers made from a first steel grade having a tensile strength of between about 250,000 psi and about 310,000 psi and the king wire made from a second steel grade having a tensile strength of between about 152,000 psi and about 198,000 psi.

16. The wire rope of claim 15 wherein the outermost layer of steel wires in each strand is made from a third steel grading having a tensile strength of between about 220,000 psi and about 250,000 psi.

17. A steel wire strand comprising a plurality of layers of steel wires helically wound around a steel king wire with all the wires in the layers made from a first steel grade AISI 1080 and the king wire made from a second steel grade AISI 1038.

18. The strand of claim 17 wherein the outermost layer of steel wires is made from a third steel grade AISI 1070.

19. A wire rope comprising a plurality of steel wire strands helically wound around a steel wire core with each strand including a plurality of layers of steel wires helically wound around a steel king wire with all the wires in the layers made from a first steel grade AISI 1080 and the king wire made from a second steel grade AISI 1038.

20. The wire rope of claim 19 wherein the outermost layer of steel wires in each strand is made from a third steel grade AISI 1070.

* * * * *